US009230760B2

(12) United States Patent
Böttcher et al.

(10) Patent No.: US 9,230,760 B2
(45) Date of Patent: Jan. 5, 2016

(54) VACUUM INTERRUPTER AND SWITCH POLE

(75) Inventors: Martin Böttcher, Berlin (DE); Frank Graskowski, Wandlitz (DE); Christoph Luft, Potsdam (DE); Ulf Schümann, Dallgow-Döberitz (DE); Gernot Swiatkowski, Berlin (DE); Jörg Teichmann, Dallgow-Döberitz (DE)

(73) Assignee: Siemens Aktiengesellschaft, München (DE)

( * ) Notice: Subject to any disclaimer, the term of this patent is extended or adjusted under 35 U.S.C. 154(b) by 87 days.

(21) Appl. No.: 14/007,065

(22) PCT Filed: Mar. 20, 2012

(86) PCT No.: PCT/EP2012/054916

§ 371 (c)(1), (2), (4) Date: Feb. 4, 2014

(87) PCT Pub. No.: WO2012/126912

PCT Pub. Date: Sep. 27, 2012

(65) Prior Publication Data

US 2014/0151339 A1 Jun. 5, 2014

(30) Foreign Application Priority Data

Mar. 24, 2011 (DE) ..... 10 2011 006 013

(51) Int. Cl.
*H01H 33/662* (2006.01)

(52) U.S. Cl.
CPC ..... *H01H 33/662* (2013.01); *H01H 33/66207* (2013.01); *H01H 33/66261* (2013.01)

(58) Field of Classification Search
CPC ..... H01H 33/06; H01H 33/66; H01H 33/662; H01H 33/66207; H01H 2033/66215; H01H 2033/66223
USPC ..... 218/136, 137, 139, 140; 200/293
See application file for complete search history.

(56) References Cited

U.S. PATENT DOCUMENTS

| | | | | |
|---|---|---|---|---|
| 4,271,340 | A | 6/1981 | Griesen | |
| 4,365,127 | A | 12/1982 | Sakuma et al. | |
| 4,410,777 | A | 10/1983 | Sakuma et al. | |
| 4,499,349 | A | 2/1985 | Sakuma et al. | |
| 5,661,281 | A | 8/1997 | Fieberg et al. | |
| 2010/0032412 | A1 | 2/2010 | Trondsen | |
| 2010/0072045 | A1 * | 3/2010 | Freundt et al. | 200/293 |

FOREIGN PATENT DOCUMENTS

| | | | |
|---|---|---|---|
| CN | 101051577 | A | 10/2007 |
| DE | 128192 | | 11/1977 |
| DE | 2852414 | A1 | 6/1979 |
| DE | 3302226 | A1 | 7/1984 |
| DE | 4422316 | A1 | 12/1994 |
| EP | 0040933 | A2 | 12/1981 |
| EP | 0080315 | A1 | 6/1983 |

* cited by examiner

*Primary Examiner* — Renee Luebke
*Assistant Examiner* — William Bolton
(74) *Attorney, Agent, or Firm* — Laurence Greenberg; Werner Stemer; Ralph Locher

(57) ABSTRACT

A vacuum interrupter has a housing with at least a first metal flange through which a first connection pin extends into the vacuum interrupter in a vacuum-tight manner to a first contact. The housing has at least one insulating-material housing region formed by a disc-like insulator. A second connection pin extends into the vacuum interrupter in a vacuum-tight manner to a second contact. The vacuum interrupter can be produced in a cost-effective manner with a compact construction. There is also described a switch pole for a switching device having a vacuum interrupter.

4 Claims, 3 Drawing Sheets

VACUUM INTERRUPTER AND SWITCH POLE

BACKGROUND OF THE INVENTION

Field of the Invention

The invention relates to a vacuum interrupter having a housing comprising at least a first metallic housing flange, through which a first connection pin extends into the vacuum interrupter in a vacuum-tight manner to a first contact, having at least one insulating-material housing region and having a second connection pin which extends into the vacuum interrupter in a vacuum-tight manner to a second contact.

Such a vacuum interrupter is known from DE 44 22 316 A1. The vacuum interrupter disclosed there comprises a housing made of a first metallic housing flange, through which a fixed-contact connection pin extends as first connection pin to a fixed contact as first contact in a vacuum-tight manner into the vacuum interrupter and also a second housing flange through which a second connection pin in the form of a moving-contact connection pin extends to a second contact in the form of a moving contact in a vacuum-tight manner movably in the vacuum interrupter, wherein an insulating material housing region is disposed between the first and the second metallic housing flange. The insulating material housing region of the vacuum interrupter of DE 44 22 316 A1 is formed by an annular hollow-cylindrical ceramic insulator, the radial wall thickness of which is almost the same size as its axial length.

BRIEF SUMMARY OF THE INVENTION

The object of the present invention is to embody a vacuum interrupter of the type described at the start, which is able to be manufactured at low cost with a compact construction.

This object is achieved in accordance with the invention, for a vacuum interrupter of the type described at the start, by the at least one insulating material housing region being formed by a disk-like insulator.

A vacuum interrupter with a disk-like insulator as an insulating material housing region has a compact construction, since the insulation strength of the vacuum interrupter is able to be realized not via the length of the insulating material housing region, but instead via its diameter or wall thickness, so that the vacuum interrupter has a compact construction as regards its length. Furthermore such a vacuum interrupter is able to be manufactured at low cost, since less conductor material is needed over the compact dimensions of the length, for example for the first and the second connection pins.

Disk-like in the sense of the present invention means here that a wall diameter of the disk-like insulator, compared to its axial length extent, is at least 1.5 times as large.

In an advantageous development of the invention the second connection pin extends through the disk-like insulator into the vacuum interrupter in a vacuum-tight manner. Such a vacuum interrupter is especially cost-effective since it only has a first metallic housing flange and the disk-like insulator is used on the one hand for insulation and on the other hand is also provided as the housing flange. Especially advantageously in this case the first connection pin is disposed in a vacuum-tight manner as fixed-contact connection pin on the first metallic housing flange and the second connection pin as moving-contact connection pin is guided in a vacuum-tight manner movably on the disk-like insulator into the inside of the vacuum interrupter.

In another advantageous embodiment of the invention, the vacuum interrupter comprises a second metallic housing flange, through which the second connection pin extends in a vacuum-tight manner into the vacuum interrupter to the second contact, wherein the disk-like insulator is disposed between the first and the second metallic housing flange. Such a vacuum interrupter likewise has a compact and thus cost-effective construction in relation to its length.

In a further advantageous embodiment of the invention a metallic housing part and a second disk-like insulator are provided between the disk-like insulator and the second metallic housing flange. A vacuum interrupter embodied in this way with the metallic housing part between the disk-like insular and the further disk-like insulator is especially advantageous for higher measurement voltages, since a capacitive voltage division of the voltage present takes place when the contact system is opened via the vacuum interrupter by the number of metallic housing parts and disk-like insulators, so that the disk-like insulators in each case only have to dielectrically insulate a part of the voltage present.

In an advantageous development of the invention the disk-like insulator has undercuts such that metal vapor occurring during the switching process does not completely cover an inner surface of the disk-like insulator. In such a disk-like insulator with such undercuts it is guaranteed that the insulation strength of the insulator is maintained even with deposited metal vapor which arises during a switching process from the arc ignited in the interrupter.

The invention further relates to a switch pole in accordance with one of the embodiments given above. Such a switch pole, as a result of the compact embodiment of the vacuum interrupter, likewise has a compact and low-cost structure, wherein in an especially advantageous way a connection of the first metallic housing flange has pole connection of the switch pole is embodied.

The invention will be explained in greater detail below with reference to the drawing and also to exemplary embodiments which relate to the enclosed figures.

DESCRIPTION OF THE INVENTION

Figure 1:
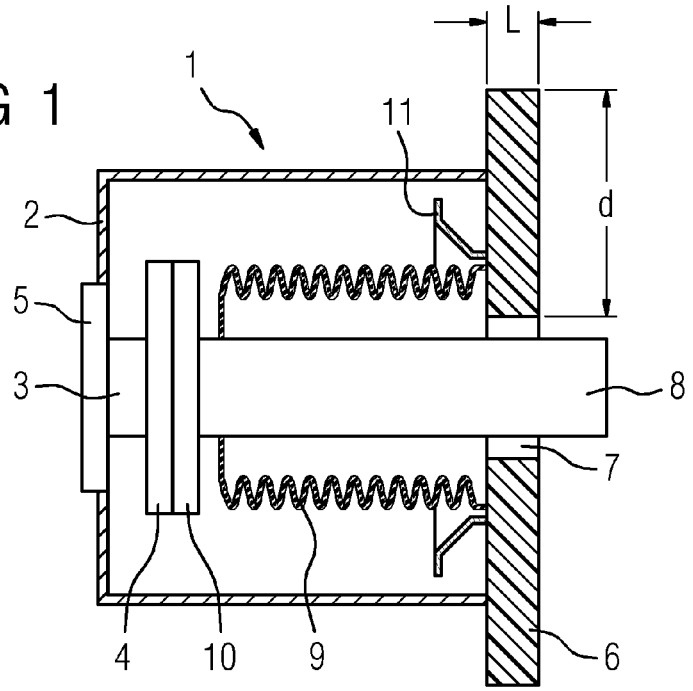
FIG. 1 shows an inventive interrupter in a first embodiment.

FIG. 1 shows a vacuum interrupter 1 with a first metallic housing flange 2 through which a first connection pin 3 extends into the inside of the vacuum interrupter 1 to a first contact 4. A first connection 5 is provided outside on the first metallic housing flange 2 as an external connection of the first connection pin 3. The vacuum interrupter 1 also comprises an insulating material housing region 6 in the form of a disk-like insulator with an opening 7, through which a second connection pin 8, which is held by means of a bellows 9 in a vacuum-tight manner movably on the insulating material housing region, extends into the inside of the vacuum interrupter 1 to a second contact 10. The second connection pin 8 is thus the moving-contact connection pin of the vacuum interrupter 1 and the second contact 10 is the moving contact of the vacuum interrupter 1. The second connection pin 8 is connected to a further connection not shown in the figure of the switching device likewise not shown in the figure, so that via the first connection 5, the first connection pin 3, the first contact 4 and the second contact 10 and the second connection pin 8 a current path for carrying a current is embodied, and is further coupled mechanically to a drive unit likewise not shown in the figure for initiating a drive movement in the second connection pin, in order to separate the second contact 10 from the first contact 4 to enable a current carried via the vacuum interrupter 1 to be interrupted. Screening elements 11 are provided in the connection region between the bellows 9 and the insulating material housing region 6, which screen the insulating material housing region 6 from being covered with the metal vapor arising during a switching process of the vacuum interrupter 1. The insulating material housing region 6 in the form of the disk-like insulator has a radial wall thickness d, which is at least 1.5 times greater than the axial length L of the disk-like insulator, wherein preferably the thickness d is a least 2 times as great, compared with the axial length L of the disk-like insulator. In such a vacuum interrupter 1 with the disk-like insulator as insulating material housing region 6 a dielectric strength or insulation capability is realized by the disk shape of the insulating housing region 6 so that the vacuum interrupter 1 can be embodied compact as regards its axial extent.

Figure 2:
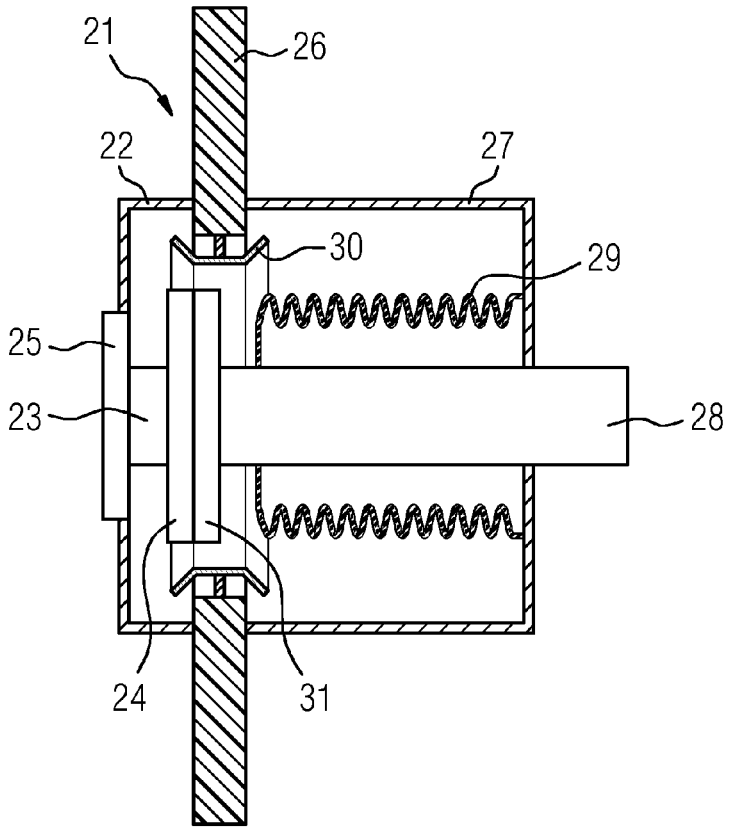
FIG. 2 shows an inventive interrupter in a second embodiment.

FIG. 2 shows a further exemplary embodiment of a vacuum interrupter 21 with a first metallic flange 22 and a first connection pin 23, a first contact 24 and also a first connection 25, wherein the first connection pin 23 extends from the first connection 25 in a vacuum-tight manner through the first metallic flange 22 into the inside of the vacuum interrupter 21 to the first contact 24, which in FIG. 2 forms the fixed contact of the vacuum interrupter 21. The vacuum interrupter 21 further comprises an insulation material housing region 26, which is adjoined by a second metallic flange 27, through which a second connection pin 28 extends into the inside of the vacuum interrupter to a second contact 31 in the form of a moving contact of the vacuum interrupter 21 and is guided movably in a vacuum-tight manner by means of a bellows 29. By contrast with the vacuum interrupter 1 of FIG. 1, in the vacuum interrupter 21 of FIG. 2 the insulating material housing region 26 is disposed in the form of the disk-like insulator between the first metallic flange 22 and a second metallic flange 27, wherein screening elements 30 are attached to the disk-like insulator of the insulating material housing region 26, which protect the insulating material housing region 26 against vapor deposition with metal vapor, wherein the screening elements 30 are not at a fixed potential, since they are attached to the insulating material 26.

Figure 3:
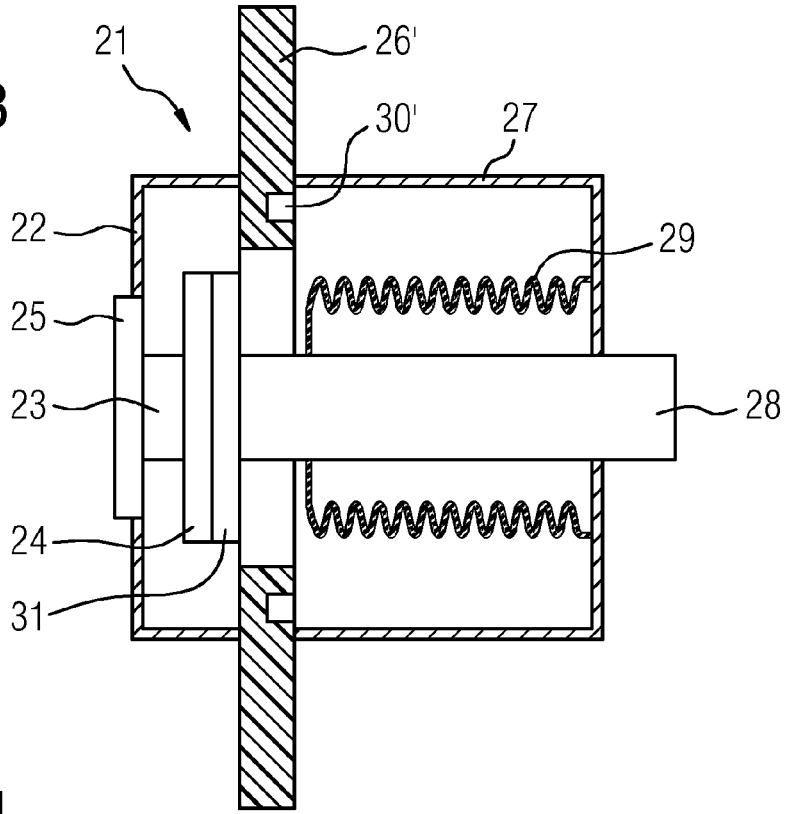
FIG. 3 shows an inventive interrupter in a third embodiment.

FIG. 3 shows the vacuum interrupter 21 of FIG. 2, wherein the same components are provided with the same reference characters. The insulating material housing region 26 of FIG. 2 in the form of the disk-like insulator is replaced in FIG. 3 by a disk-like insulator 26', wherein undercuts are provided as screening elements 30', which are embodied such that metal vapor occurring during the switching process cannot fully cover an inner surface of the disk-like insulator 26', so that the insulation capability of the disk-like insulator 26' inside the vacuum interrupter is maintained.

Figure 4:
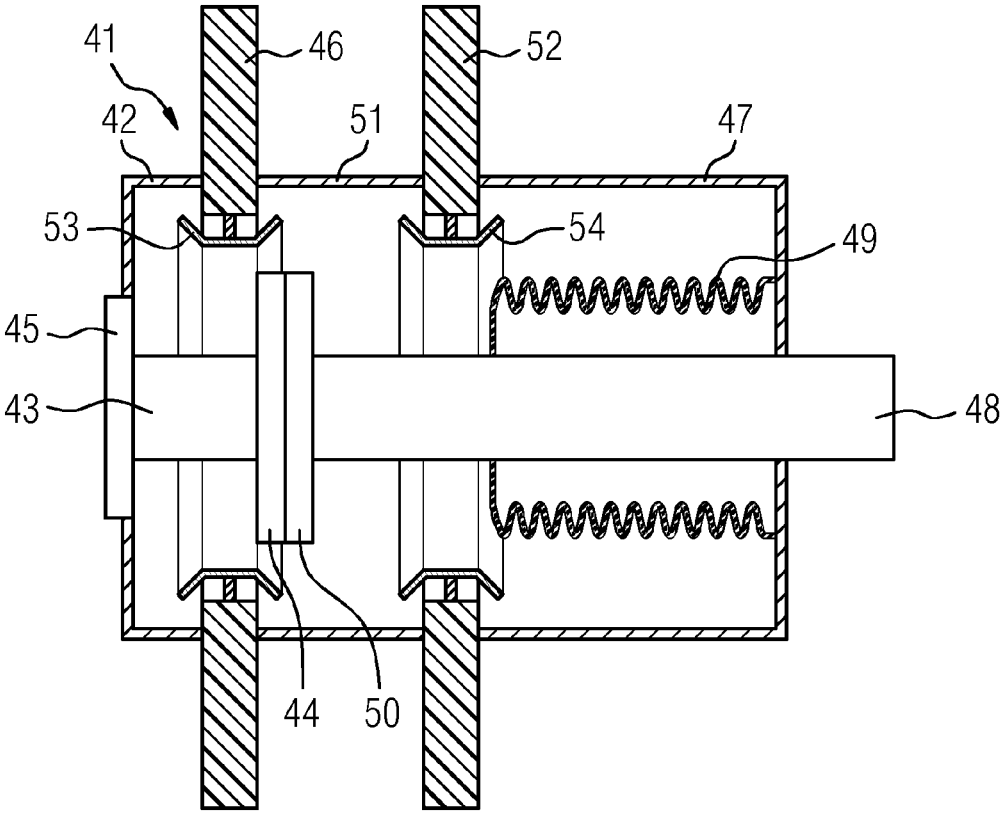
FIG. 4 shows an inventive interrupter in a fourth embodiment.

FIG. 4 shows a vacuum interrupter 41 with a first metallic flange 42, a first connection pin 43 and first contact 44 as well as a first connection 45, a first insulating material housing region 46 in the form of a disk-like insulator, a second metallic flange 47 and a second connection pin 48, which extends in a vacuum-tight manner by means of a bellows 49 movably through the second metallic flange 47 into the inside of the vacuum interrupter 41 to a second contact 50, which represents the moving contact of the vacuum interrupter 41. Between the first insulating material housing region 46 and the second metallic flange 47 a further metallic housing part 51 and also a second insulating material housing region 52 are provided, so that the vacuum interrupter 41 has a number of insulating material housing regions with metallic housing parts disposed between them, wherein screening elements 53 and 54 are disposed on the insulating material housing regions 46 and 52, which screen the insulating housing regions 46 and 52 from deposition of metal vapor during a switching process. Through the further metallic housing part 51, a voltage present at the vacuum interrupter 41 with an opened contact system comprising first contact 44 and second contact 50 is distributed capacitively over the various metallic housing parts, which is especially di-electrically useful with higher measured voltages.

Figure 5:
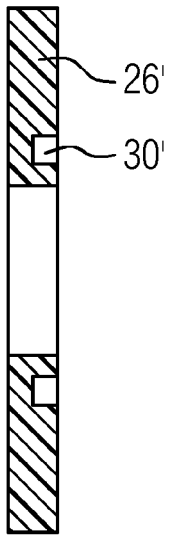
FIG. 5 shows an exemplary embodiment of a disk-like insulator of the inventive vacuum interrupter.
Figure 6:
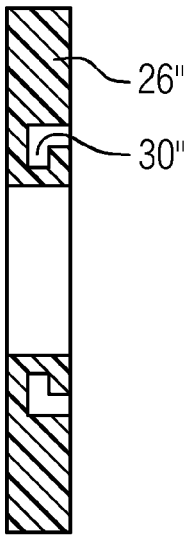
FIG. 6 shows a further exemplary embodiment of a disk-like insulator of the inventive vacuum interrupter.

FIGS. 5 and 6 shows various embodiments of disk-like insulators 26' or 26" with undercuts 30' or 30" which implement the function of screening from metal vapor on the inner surface of the disk-like insulator already explained in greater detail with reference to FIG. 3.

The undercut 30' of FIG. 5 in this case is a simple cutout in the disk-like insulator 26', the undercut 30" of FIG. 6 represents an L-shaped undercut through which an especially effective screening function is achieved.

Figure 7:
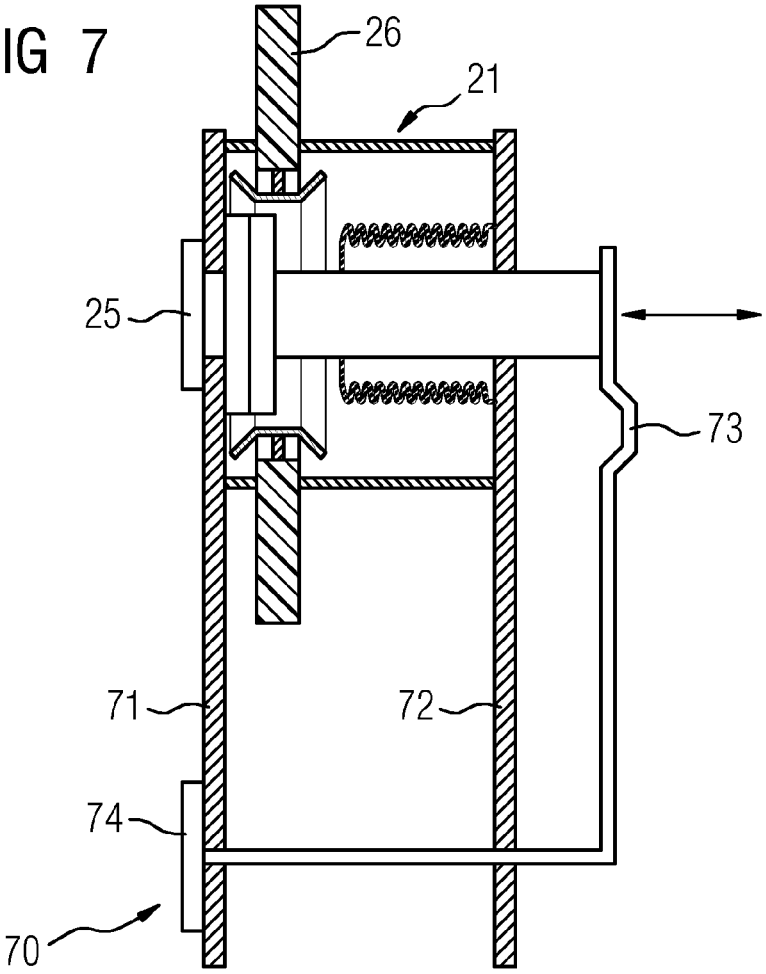
FIG. 7 shows an exemplary embodiment of the switch pole and use of an exemplary embodiment of an inventive vacuum interrupter.

FIG. 7 shows a switch pole 70 which has the vacuum interrupter 21 from FIG. 2 supported on a support structure 71, 72. Instead of the vacuum interrupter 21 of FIG. 2, the vacuum interrupters 1 or 31 of FIG. 1 or 3 can also be provided for the inventive switch pole. Via the first connection 25, the first connection pin 23, the first contact 24, the second contact 31 and also the second connection pin 28 and a flexible connecting element 73, which is routed to a second connection 74 of the switch pole 70, a current path of the switch pole 70 is embodied, which by initiating a drive movement of a drive not shown in the figure, represented schematically by the double-ended arrow of FIG. 7, can be switched on or interrupted.

The disk-like insulators 6, 26, 26', 26", 46 and 52 all have the property described in relation to FIG. 1 that their radial thickness d is at least 1.5 times as great as their axial length L, so that the insulation capability of the vacuum interrupter and its dielectric strength is realized via the radial extent of the disk-like insulators as insulating material housing regions, which in all exemplary embodiments shown, leads to a compact and thus low-cost structure.

LIST OF REFERENCE CHARACTERS

1 Vacuum interrupter
2 First metallic flange
3 First connection pin
4 First contact
5 First connection
6 Insulating material housing region
7 Opening
8 Second connection pin
9 Bellows
10 Second contact

11 Screening element
21 Vacuum interrupter
22 First metallic flange
23 First connection pin
24 First contact
25 First connection
26 Insulating material housing region
26', 26" Insulating material housing region
27 Second metallic flange
28 Second connection pin
29 Bellows
30 Screening elements
30', 30" Screening elements
31 Second contact
41 Vacuum interrupter
42 First metallic flange
43 First connection pin
44 First contact
45 First connection
46 First insulation material housing region
47 Second metallic flange
48 Second connection pin
49 Bellows
50 Second contact
51 Metallic housing part
52 Second insulation material housing region
53, 54 Screening elements
70 Switch pole
71, 72 Support structure
73 Flexible connecting element
74 Second connection
d Radial wall thickness
L Axial length

The invention claimed is:

1. A vacuum interrupter, comprising:

a housing having a first metallic flange and a second metallic flange;

a first connection pin extending through said first metallic flange in a vacuum-tight manner into the vacuum interrupter to a first contact inside said housing;

a second connection pin extending through said second metallic flange into the vacuum interrupter in a vacuum-tight manner to a second contact inside said housing: and at least one insulating material housing region formed of a disk-shaped insulator disposed between said first and second metallic flanges;

wherein said housing is formed with a metallic housing part and wherein a further disk-shaped insulator and said metallic housing part are disposed between said disk-shaped insulator and said second metallic flange.

2. The vacuum interrupter according to claim 1, wherein said second connection pin extends through said disk-shaped insulator in a vacuum-tight manner into the vacuum interrupter.

3. A switch pole, comprising:

a vacuum interrupter according to claim 1; and a support structure holding said vacuum interrupter.

4. A vacuum interrupter, comprising:

a housing having at least one metallic flange;

a first connection pin extending through said at least one metallic flange in a vacuum-tight manner into the vacuum interrupter to a first contact inside said housing;

a second connection pin extending into the vacuum interrupter in a vacuum-tight manner to a second contact inside said housing; and at least one insulating material housing region formed of a disk-shaped insulator, wherein said disk-shaped insulator is formed with undercuts such that metal vapor occurring during the switching process does not completely cover an inner surface of said disk-shaped insulator.

* * * * *